US010205217B2

(12) United States Patent
Svendsen

(10) Patent No.: US 10,205,217 B2
(45) Date of Patent: Feb. 12, 2019

(54) ANTENNA FOR WIRELESS COMMUNICATION DEVICE CHASSIS HAVING REDUCED CUTBACK

(71) Applicant: Intel IP Corporation, Santa Clara, CA (US)

(72) Inventor: Simon Svendsen, Aalborg (DK)

(73) Assignee: Intel IP Corporation, Santa Clara, CA (US)

( * ) Notice: Subject to any disclaimer, the term of this patent is extended or adjusted under 35 U.S.C. 154(b) by 60 days.

(21) Appl. No.: 14/757,819

(22) Filed: Dec. 23, 2015

(65) Prior Publication Data

US 2017/0187093 A1 Jun. 29, 2017

(51) Int. Cl.

| | |
|---|---|
| ***H01Q 1/22*** | (2006.01) |
| ***H01Q 1/24*** | (2006.01) |
| ***H01Q 1/48*** | (2006.01) |

(52) U.S. Cl.

CPC ..... *H01Q 1/2266* (2013.01); *H01Q 1/2258* (2013.01); *H01Q 1/2291* (2013.01); *H01Q 1/241* (2013.01); *H01Q 1/243* (2013.01); *H01Q 1/48* (2013.01)

(58) Field of Classification Search

CPC ..... H01Q 13/10; H01Q 1/243; H01Q 9/0457

See application file for complete search history.

(56) References Cited

U.S. PATENT DOCUMENTS

2012/0154222 A1 6/2012 Oh et al.
2012/0162040 A1* 6/2012 Taura ..... G06F 1/1698 343/770
2012/0313830 A1 12/2012 Lee
2014/0184450 A1* 7/2014 Koo ..... H01Q 5/335 343/702
2014/0347225 A1* 11/2014 Harper ..... H01Q 5/328 343/702

FOREIGN PATENT DOCUMENTS

EP 1653714 A1 5/2006
EP 2421093 A1 2/2012

OTHER PUBLICATIONS

Extended European Search report dated May 22, 2017 for European Patent Application No. 16198465.3.

* cited by examiner

*Primary Examiner* — Daniel J Munoz
(74) *Attorney, Agent, or Firm* — Schiff Hardin LLP

(57) ABSTRACT

An antenna having a passive antenna element that is integrated in a wireless communication chassis, is naturally in resonance, and is galvanically coupled to ground, and a passive indirect antenna element feed that is non-galvanically coupled to the antenna element. If the chassis is foldable, a parasitic element may be located opposite an antenna element feed when the foldable chassis is in at least one of a closed mode and a tablet mode.

18 Claims, 4 Drawing Sheets

ANTENNA FOR WIRELESS COMMUNICATION DEVICE CHASSIS HAVING REDUCED CUTBACK

TECHNICAL FIELD

The present disclosure generally relates to an antenna, and more specifically, to an antenna for a wireless communication device chassis having a reduced cutback, and optionally a parasitic element that counteracts negative effects of a changing environment of a chassis that is metal and foldable.

BACKGROUND

The number of antennas needed in wireless devices such as laptops, tablets, and phablets is increasing. This is a challenge due to the volume required for each antenna to achieve good performance. The performance of an antenna in any device is related to the volume allocated and the physical placement within the device. The best performance is typically obtained when an antenna is placed at a circumference of the device. However, trends in design are moving towards minimizing the bezel around the display and using full metal chasses in order to reduce the thickness of the device while maintaining mechanical strength and an appealing design. This design leaves less space for antennas, and traditional antennas require a chassis cutback (i.e., size of the bezel) of 12-14 mm for a passive antenna covering 699-960 MHz and 1710-2690 MHz. The cutback of these traditional antenna designs can be reduced to around 10 mm by reducing the available impedance bandwidth of the antennas and using different tunings of the antennas for different regions.

DESCRIPTION OF THE ASPECTS

The present disclosure is directed to an antenna having a passive antenna element that is integrated in a wireless communication chassis, is naturally in resonance, and is galvanically coupled to ground, and a passive indirect antenna element feed that is non-galvanically coupled to the antenna element. If the chassis is foldable, a parasitic element may be located opposite an antenna element feed when the foldable chassis is in at least one of a closed mode and a tablet mode.

The antenna of the present disclosure results in a chassis having a reduced cutback as compared with traditional devices. The antenna is Electro-Static Discharge (ESD)-resilient because the antenna elements are shorted galvanically to ground and all feeds are non-galvanically coupled to the antenna elements. Also, the parasitic element counteracts negative effects of a changing environment of a metal chassis device.

Figure 1A:
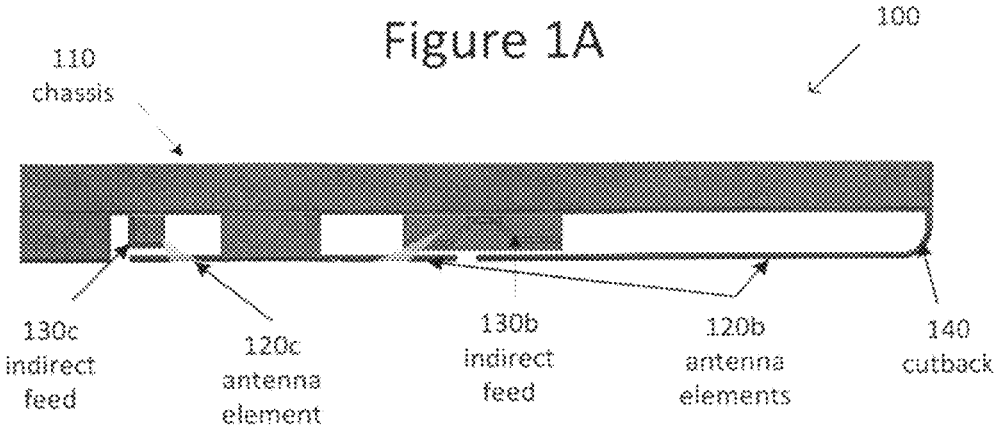
FIGS. 1A-1C illustrate schematic diagrams of chassis-integrated antennas of a wireless communication device in accordance with an aspect of the disclosure.
Figure 1B:
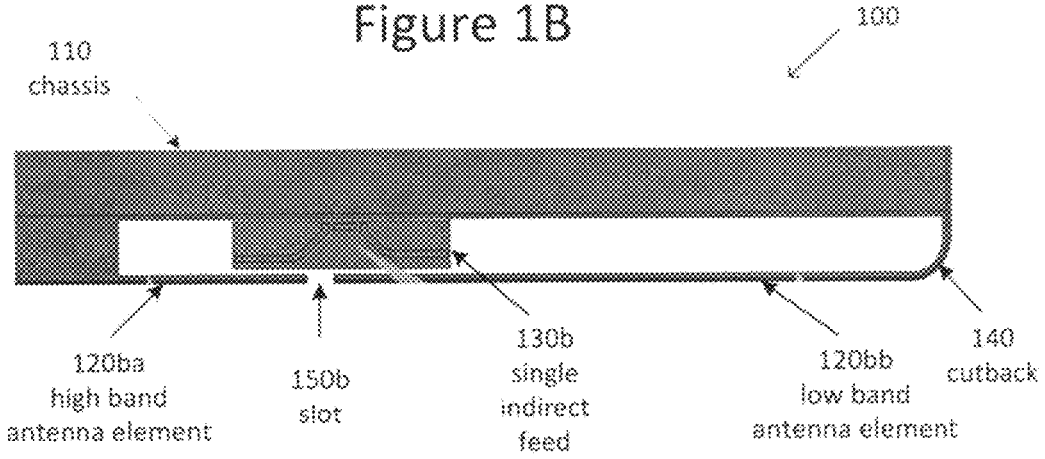
Figure 1C:
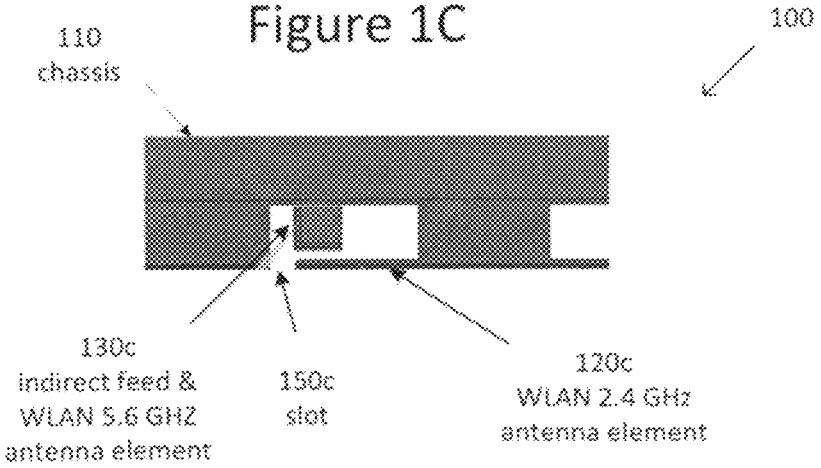

FIGS. 1A-1C illustrate schematic diagrams of chassis-integrated antennas of a wireless communication device 100 in accordance with an aspect of the disclosure.

The wireless communication device 100 comprises a chassis 110, antenna elements 120*b*, 120*c*, indirect antenna element feeds 130*b*, 130*c*, and a cutback 140. The chassis 110 may be comprised of a metal, though the disclosure is not limited in this respect. The chassis is defined as the display (i.e., lid) and base without the antenna(s) (antenna elements 120 and feeds 130).

The antenna elements 120*b*, 120*c* are integrated in the chassis 110 by adding one or two slots in the chassis 110 around a top or side of a display portion and/or the bottom or side of a base portion of the chassis 110. The antenna elements 120*b*, 120*c* are each ¼-wave antenna elements. The antenna having antenna elements 120*b* is shown as a Wireless Wide Area Network (WWAN) antenna. The antenna having antenna element 120*c* is shown as a Wireless Local Area Network (WLAN) antenna. Of course WWAN and WLAN are examples of types of antennas. The disclosure is not limited in these respects. The wireless communication device 100 may have any number of antennas, and any kind(s) of antenna(s) as suitable for the intended purpose. The lengths of the respective antenna elements 120*b*, 120*c* determine respective resonance frequencies.

Antenna element 120*b* has indirect feed 130*b*, and antenna elements 120*c* have indirect feed 130*c*. As is known, an antenna feed 130 refers to components of an antenna element 120 which feed radio waves to the rest of the antenna, or in a receiving antenna collects incoming radio waves, converts the incoming radio waves to electric currents, and transmits the electric currents to the receiver. The antenna elements 120*b*, 120*c* are fed indirectly by couplers on a Printed Circuit Board (PCB) placed between the respective antenna elements 120*b*, 120*c* and the chassis 110. No galvanic contacts are needed from radio frequency feed signals to the antenna elements 120*b*, 120*c*. In the examples shown the antenna element 120*b* has a single feed, and the antenna elements 120*c* has a single feed. However, the disclosure is not limited in this respect. The single feeds may alternatively be dual feeds by changing how the couplers are placed on the PCB. In a wireless communication device a single feed antenna is more common that a dual feed antenna so as to avoid routing two coaxial cables to the antenna elements.

The antenna elements 120*b*, 120*c* are passive, that is, no active components are connected to the antenna system to change the resonance frequency of the element and/or the impedance transformation of the matching circuit. The antennas of this disclosure are described as covering from approximately 699-960 MHz and approximately 1710-2690 MHz, though the disclosure is not limited in this respect. Also, the antenna elements 120*b*, 120*c* are galvanically-coupled to the chassis 110 (i.e., ground), so there are no floating elements, and the device 100 is ESD-resilient. The indirect antenna element feeds 130*b*, 130*c* are non-galvanically coupled to the respective antenna elements 120*b*, 120*c*. The elements could be coupled to the chassis via an inductor in order to reduce the physical length of the elements. This will, however, also reduce the impedance bandwidth, add additional slots and make the elements floating, that is, notno directly coupled to the chassis.

Due to the antenna design, the chassis 110 has a cutback 140 of only approximately 6.5 mm, which is less than that of traditional designs achieving a similar operating frequency range. A cutback is defined as a distance measured from inside of the antenna element 120*b*, 120*c* to the chassis 110. The cutback determines an antenna's bandwidth. Also, in the example shown, with this cutback the antenna elements 120*a*, 120*b* together are configured to cover a frequency range of approximately 699-960 MHz and approximately 1710-2690 MHz, though again, the disclosure is not limited in this respect.

The wireless communication device 100 may a laptop, tablet, phablet, or any other similar wireless communication device.

FIG. 1B illustrates a schematic diagram showing more detail of the WWAN antenna element 120*b* of FIG. 1A.

The WWAN antenna element 120*b* comprises a high band antenna element 120*ba*, a low band antenna element 120*bb*, a single indirect feed 130*b*, and a slot 150*b*. The longer low band antenna element 120*bb* faces the smaller high band antenna element 120*ba*. Both elements 120*bb*, 120*ba* are part of the base or display portion of the metal chassis. The elements 120*bb* 120*ba* are naturally at resonance at a desired frequency in order to maximize the impedance bandwidth and the radiated performance. The indirect feed 130*b* is in this example implemented on a standard FR4 PCB and includes a low and high band coupler and two matching coils.

FIG. 1C illustrates a schematic diagram showing more detail of the WLAN antenna 120*c* of FIG. 1A.

The WLAN antenna has a 2.4 GHz antenna element 120*c*, an indirect feed 130*c* which is also a 5.6 GHz antenna element in this example, and a slot 150*c*. The WLAN antenna is implemented in a same manner as the WWAN antenna, except the WLAN feed is also used as the radiating portion for WLAN 5.6 GHz.

Figure 2A:
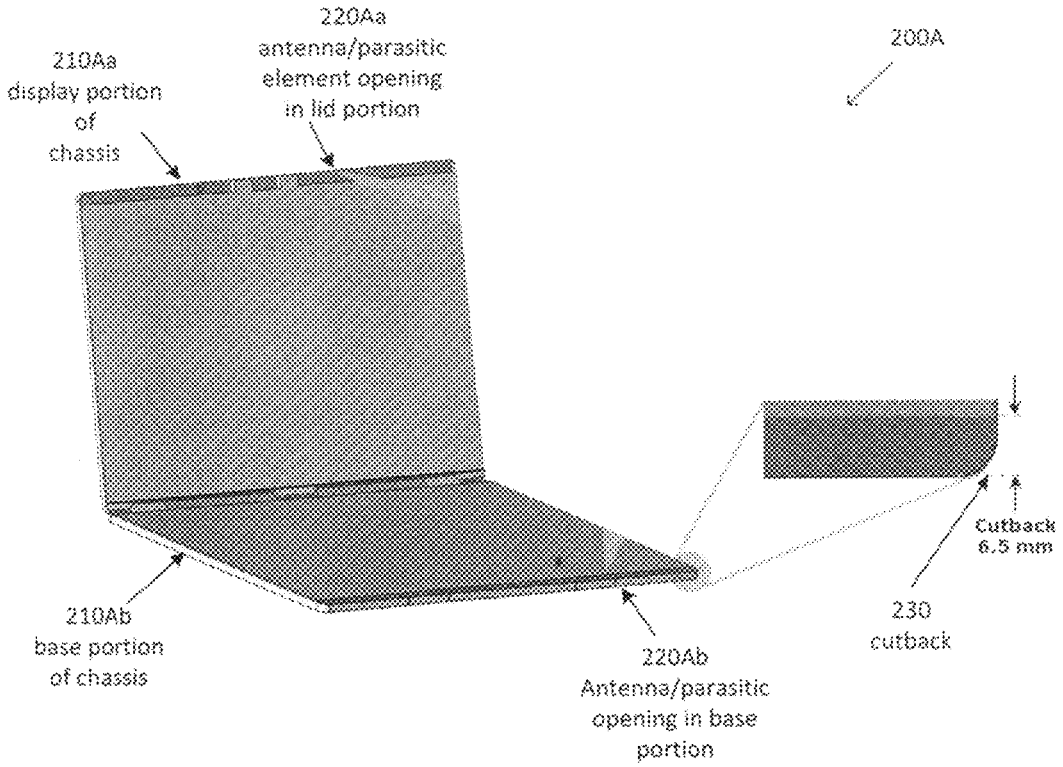
FIGS. 2A and 2B illustrate schematic diagrams of a wireless communication device in accordance with an aspect of the disclosure.
Figure 2B:
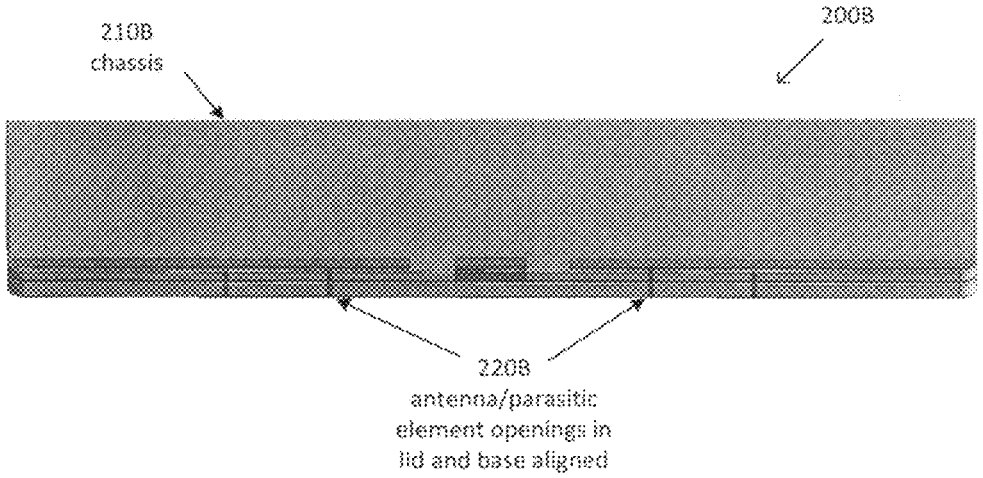

FIGS. 2A and 2B illustrate schematic diagrams of a wireless communication device 200 having a foldable chassis 210 in accordance with an aspect of the disclosure.

The foldable chassis 210 has a display portion 210Aa and a base portion 210Ab. The foldable chassis 210 may be configured to be in any of an open mode, a closed mode, and a tablet mode. The foldable chassis 210A shown in FIG. 2A is shown in an open mode. The foldable chassis 210B shown in FIG. 2B is shown in the closed mode with slots 210B in the display portion 2*s*0Aa and base portion 210Ab aligned.

Often an antenna element is located at the top of the display portion 210Aa, so when the foldable chassis 210 is the open mode the antenna element is surrounded by the chassis' display portion 210Aa. If the chassis 210 is comprised of metal, the top portion of the chassis 210 has a non-conductive opening 220A comprised of, for example, plastic, so the antenna element can radiate through the plastic.

The wireless communication device 200 has a changing antenna environment caused by the foldable chassis 210 rotating between open, closed, and tablet modes on a 360° hinge. This change in environment has an impact on antenna performance when the display portion 210Aa and the base portion 210Ab are comprised of metal. Any antenna elements located in the display portion 210Aa or base portion 210Ab experience an increase in Q factor, which results in high loss and impedance detuning when the device 200 is either in the closed or tablet mode, since the metal of the two portions (display portion 210Aa and base portion 210Ab) of the chassis 210 short the antenna.

This detuning of the antenna may be counteracted by adding one or more parasitic elements in an opposite portion of where the radio frequency signal is fed to the antenna elements. These parasitic elements may have the same dimensions as the antenna elements and contribute to the radiation when the device 200 is in the closed or tablet mode.

More specifically, the foldable chassis 210 may have an opening for an antenna element 220Aa in the display portion 210Aa and an opening for a parasitic element 220Ab in the base portion 210Ab, or vice versa. The parasitic element is located opposite an antenna element feed when the foldable chassis 210 is in at least one of the closed mode and tablet modes. The parasitic element also radiates in the closed and tablet modes. There will therefore not be degradation in performance as compared with the open mode.

Many of the elements of FIGS. 2A and 2B are similar to those as described above with respect to FIGS. 1A-1C. For example, the antenna elements are ¼-wave elements that may be used in a WWAN, MAN, or any other type of antenna as suitable for the intended purpose. The feed may be a single feed or dual feed. Also, the foldable chassis 210 may be comprised of a metal, but the disclosure is not limited in this respect. The wireless communication device 200 may be a laptop, tablet, phablet, or other similar device, and has a reduced-size cutback of approximately 6.5 mm.

Figure 3:
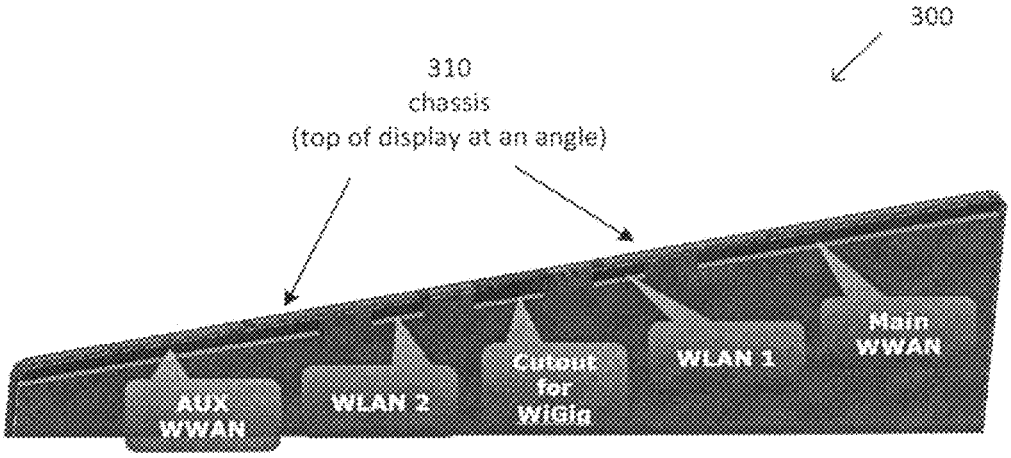
FIG. 3 illustrates a schematic diagram of a top of a display portion of a wireless communication device in accordance with an aspect of the disclosure.

FIG. 3 illustrates a schematic diagram of a top of a display portion (shown at an angle which device is open) of a chassis 310 of a wireless communication device 300 in accordance with an aspect of the disclosure.

The display portion comprise across its top edge from right to left antenna openings for a main WWAN antenna, a WLAN 1 antenna, a Wireless Gigabit (WiGig) antenna, WLAN 2 antenna, and an auxiliary (AUX) WWAN antenna. The main WWAN antenna and the AUX WWAN antenna are identical; the AUX WLAN antenna is normally for receiving data only in order to have higher data throughput. There are two WLANs antenna (WLAN1 and WLAN2) in order to obtain better data throughput. These antennas are known, and for the sake of brevity, their descriptions will be omitted here.

Figure 4:
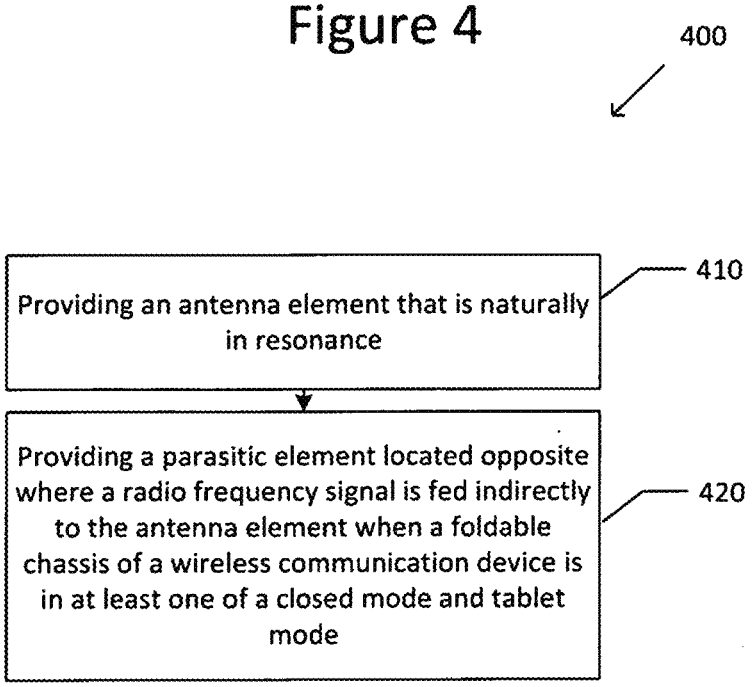
FIG. 4 illustrates a flowchart of a method in accordance with an aspect of the disclosure.

FIG. 4 illustrates a flowchart of a method in accordance with an aspect of the disclosure.

In Step 410, an antenna element that is naturally in resonance is provided.

In Step 420, a parasitic element located opposite an antenna element feed when a foldable chassis of a wireless communication device is in at least one of a closed mode and tablet mode is provided.

Example 1 is an antenna, comprising an antenna element that is naturally in resonance; and a parasitic element located opposite an antenna element feed when a foldable chassis of a wireless communication device is in at least one of a closed mode and a tablet mode.

In Example 2, the subject matter of Example 1, wherein the foldable chassis is configurable to be in any of an open mode, the closed mode, and the tablet mode.

In Example 3, the subject matter of Example 1, wherein the antenna is a ¼-wave antenna.

In Example 4, the subject matter of Example 1, further comprising a single antenna feed.

In Example 5, the subject matter of Example 1, further comprising a dual antenna feed.

In Example 6, the subject matter of Example 1, wherein the foldable chassis is comprised of a metal.

In Example 7, the subject matter of Example 1, wherein the antenna is a Wireless Wide Area Network (WWAN) antenna.

In Example 8, the subject matter of Example 1, wherein the antenna is a Wireless Local Area Network (WLAN) antenna.

In Example 9, the subject matter of Example 1, wherein the wireless communication device selected from the group of wireless communication devices consisting of laptops, tablets, and phablets.

Example 10 is an antenna, comprising a passive antenna element that is integrated in a wireless communication chassis, is naturally in resonance, and is galvanically coupled to ground; and a passive indirect antenna element feed that is non-galvanically coupled to the antenna element.

In Example 11, the subject matter of Example 10, wherein the chassis has a cutback of approximately 6.5 mm.

In Example 12, the subject matter of Example 10, wherein the antenna is a ¼-wave antenna.

In Example 13, the subject matter of Example 10, wherein the indirect antenna element feed is a single indirect antenna element feed.

In Example 14, the subject matter of Example 10, wherein the indirect antenna element feed is a dual indirect antenna element feed.

In Example 15, the subject matter of Example 10, wherein the chassis is comprised of a metal.

In Example 16, the subject matter of Example 10, wherein the antenna element is configured to cover a frequency range of approximately 699-960 MHz and approximately 1710-2690 MHz.

In Example 17, the subject matter of Example 10, wherein the antenna is a Wireless Wide Area Network (WWAN) antenna.

In Example 18, the subject matter of Example 10, wherein the antenna is a Wireless Local Area Network (WLAN) antenna.

In Example 19, the subject matter of Example 10, wherein the wireless communication device is selected from the group of wireless communication devices consisting of laptops, tablets, and phablets.

Example 20 is a method providing an antenna, comprising providing an antenna element that is naturally in resonance; and providing a parasitic element located opposite an antenna element feed when a foldable chassis of a wireless communication device is in at least one of a closed mode and tablet mode.

In Example 21, the subject matter of Example 20, wherein the antenna is a ¼-wave antenna.

In Example 22, the subject matter of Example 20, further comprising providing a single antenna feed.

In Example 23, the subject matter of Example 20, further comprising providing a dual antenna feed.

In Example 24, the subject matter of Example 20, wherein the foldable chassis is comprised of a metal.

In Example 25, the subject matter of Example 20, wherein the wireless communication device has an open mode, the closed mode, and the tablet mode.

Example 26 is an antenna, comprising an antenna element means that is naturally in resonance; and a parasitic element means located opposite an antenna element feed when a foldable chassis of a wireless communication device is in at least one of a closed mode and a tablet mode.

In Example 27, the subject matter of Example 26, wherein the foldable chassis is configurable to be in any of an open mode, the closed mode, and the tablet mode.

In Example 28, the subject matter of Example 26, wherein the antenna is a ¼-wave antenna.

In Example 29, the subject matter of any of Examples 26-28, further comprising a single antenna feed.

In Example 30, the subject matter of any of Examples 26-28, further comprising a dual antenna feed.

In Example 31, the subject matter of any of Examples 26-28, wherein the foldable chassis is comprised of a metal.

In Example 32, the subject matter of any of Examples 26-28, wherein the antenna is a Wireless Wide Area Network (WWAN) antenna.

In Example 33, the subject matter of any of Examples 26-28, wherein the antenna is a Wireless Local Area Network (WLAN) antenna.

In Example 34, the subject matter of any of Examples 26-28, wherein the wireless communication device selected from the group of wireless communication devices consisting of laptops, tablets, and phablets.

Example 35 is an antenna, comprising a passive antenna element means that is integrated in a wireless communication chassis, is naturally in resonance, and is galvanically coupled to ground; and a passive indirect antenna element feed means that is non-galvanically coupled to the antenna element.

In Example of 36, the subject matter of Example 35, wherein the chassis has a cutback of approximately 6.5 mm.

In Example of 37, the subject matter of Example 35, wherein the antenna is a ¼-wave antenna.

In Example of 38, the subject matter of any of Examples 35-37, wherein the indirect antenna element feed means is a single indirect antenna element feed means.

In Example of 39, the subject matter of any of Examples 35-37, wherein the indirect antenna element feed means is a dual indirect antenna element feed means.

In Example of 40, the subject matter of any of Examples 35-37, wherein the chassis is comprised of a metal.

In Example of 41, the subject matter of any of Examples 35-37, wherein the antenna element means is configured to cover a frequency range of approximately 699-960 MHz and approximately 1710-2690 MHz.

In Example of 42, the subject matter of any of Examples 35-37, wherein the antenna is a Wireless Wide Area Network (WWAN) antenna.

In Example of 43, the subject matter of any of Examples 35-37, wherein the antenna is a Wireless Local Area Network (WLAN) antenna.

In Example of 44, the subject matter of any of Examples 35-37, wherein the wireless communication device is selected from the group of wireless communication devices consisting of laptops, tablets, and phablets.

Example 45 is a method providing an antenna, comprising providing an antenna element means that is naturally in resonance; and providing a parasitic element means located opposite an antenna element feed means when a foldable chassis of a wireless communication device is in at least one of a closed mode and tablet mode.

In Example of 46, the subject matter of Example 20, wherein the antenna is a ¼-wave antenna.

In Example of 47, the subject matter of any of Examples 45 and 46, further comprising: providing a single antenna feed.

In Example of 48, the subject matter of any of Examples 45 and 46, further comprising: providing a dual antenna feed.

In Example of 49, the subject matter of any of Examples 45 and 46, wherein the foldable chassis is comprised of a metal.

In Example of 50, the subject matter of any of Examples 45 and 46, wherein the wireless communication device has an open mode, the closed mode, and the tablet mode.

Example 51 is an apparatus substantially as shown and described.

Example 52 a method substantially as shown and described.

While the foregoing has been described in conjunction with exemplary aspect, it is understood that the term "exemplary" is merely meant as an example, rather than the best or optimal. Accordingly, the disclosure is intended to cover alternatives, modifications and equivalents, which may be included within the scope of the disclosure.

Although specific aspects have been illustrated and described herein, it will be appreciated by those of ordinary skill in the art that a variety of alternate and/or equivalent implementations may be substituted for the specific aspects shown and described without departing from the scope of the present application. This application is intended to cover any adaptations or variations of the specific aspects discussed herein.

The invention claimed is:

1. An antenna, comprising:

an antenna element that is formed from a slot made in a first portion of a metallic foldable chassis of a wireless communication device; and a parasitic element formed from a slot made in a second portion of the metallic foldable chassis, the slot associated with the antenna element and the slot associated with the parasitic element being aligned with one another as a result of the first portion and the second portion of the metallic foldable chassis being folded together to cause the parasitic element to radiate with the antenna element and to compensate for impedance detuning of the antenna element caused by folding the metallic foldable chassis, wherein the metallic foldable chassis is configurable to be in any of an open mode, a closed mode, and a tablet mode, wherein the metallic foldable chassis is folded when in the closed mode or the tablet mode and results in the slot associated with the antenna element and the slot associated with the parasitic element being aligned with one another, and wherein the metallic foldable chassis is unfolded when in the open mode and results in the slot associated with the antenna element and the slot associated with the parasitic element being misaligned with one another.

2. The antenna of claim 1, wherein the antenna element is a ¼-wave antenna element.

3. The antenna of claim 1, further comprising a single antenna feed coupled to the antenna element.

4. The antenna of claim 1, further comprising a dual antenna feed coupled to the antenna element.

5. The antenna of claim 1, wherein the antenna is a Wireless Wide Area Network (WWAN) antenna.

6. The antenna of claim 1, wherein the antenna is a Wireless Local Area Network (WLAN) antenna.

7. The antenna of claim 1, wherein the wireless communication device is selected from the group of wireless communication devices consisting of laptops, tablets, and phablets.

8. The antenna of claim 1, wherein the parasitic element is configured to radiate when the metallic foldable chassis is in the closed mode or the tablet mode, and to not radiate when the metallic foldable chassis is in the open mode.

9. The antenna of claim 1, further comprising:

an indirect antenna element feed that is non-galvanically coupled to the antenna element.

10. The antenna of claim 1, wherein the metallic foldable chassis has a cutback distance defined as an offset distance between a first plane that includes the slot associated with the antenna element, and a second plane that is parallel to the first plane, the impedance bandwidth of the antenna element being a function of the cutback distance such that a smaller cutback distance reduces the impedance bandwidth, and wherein, when the metallic foldable chassis is in the closed mode or the tablet mode, the antenna element operates in conjunction with the parasitic element to achieve an impedance bandwidth for a smaller cutback distance as compared to the cutback distance required to achieve the same impedance bandwidth in the absence of the parasitic element.

11. A method providing an antenna, comprising:

providing an antenna element that is formed from a slot made in a first portion of a metallic foldable chassis of a wireless communication device;

providing a parasitic element formed from a slot made in a second portion of the metallic foldable chassis;

folding the metallic foldable chassis of the wireless communication device to align the slot associated with the antenna element and the slot associated with the parasitic element to cause the parasitic element to radiate with the antenna element, wherein the parasitic element radiating with the antenna element compensates for impedance detuning of the antenna element caused by folding the metallic foldable chassis, wherein the wireless communication device has an open mode, a closed mode, and a tablet mode, wherein the metallic foldable chassis is folded when the wireless communication device is in the closed mode or the tablet mode and results in the slot associated with the antenna element and the slot associated with the parasitic element being aligned with one another, and wherein the metallic foldable chassis is unfolded when in the open mode and results in the slot associated with the antenna element and the slot associated with the parasitic element being misaligned with one another.

12. The method of claim 11, wherein the act of providing the antenna element includes providing a ¼-wave antenna element.

13. The method of claim 11, further comprising:

providing a single antenna feed to the antenna element.

14. The method of claim 11, further comprising:

providing a dual antenna feed to the antenna element.

15. A wireless communication device, comprising:

a metallic foldable chassis having a top portion and a bottom portion;

an antenna element that is formed from a slot made in one of the top portion or the bottom portion of the metallic foldable chassis; and a parasitic element that is formed from a slot made in one of the top portion or the bottom portion of the metallic foldable chassis that is located opposite to the antenna element, the slot associated with the antenna element and the slot associated with the parasitic element being aligned with one another as a result of the top portion and the bottom portion of the metallic foldable chassis being folded together to cause the parasitic element to radiate with the antenna element and compensate for impedance detuning of the antenna element caused by folding the metallic foldable chassis, wherein the wireless communication device has an open mode, a closed mode, and a tablet mode, wherein the metallic foldable chassis is folded when the wireless communication device is in the closed mode or the tablet mode and results in the slot associated with the antenna element and the slot associated with the parasitic element being aligned with one another, and wherein the metallic foldable chassis is unfolded when in the open mode and results in the slot associated with the antenna element and the slot associated with the parasitic element being misaligned with one another.

16. The wireless communication device of claim 15, wherein the parasitic element is configured to radiate when the metallic foldable chassis is in the closed mode or the tablet mode, and to not radiate when the metallic foldable chassis is in the open mode.

17. The wireless communication device of claim 16, further comprising:

an indirect antenna element feed that is non-galvanically coupled to the antenna element.

18. The wireless communication device of claim 16, wherein the antenna element and the parasitic element are galvanically coupled to ground via the metallic foldable chassis.

* * * * *